United States Patent [19]

Herrgord

[11] Patent Number: 4,711,046

[45] Date of Patent: Dec. 8, 1987

[54] LIGHTWEIGHT MULTI-PANEL DISPLAY

[76] Inventor: Donald E. Herrgord, P.O. Box 1266, Muskegon, Mich. 49443

[21] Appl. No.: 706,107

[22] Filed: Feb. 27, 1985

[51] Int. Cl.[4] ..... G09F 7/00

[52] U.S. Cl. ..... 40/605; 40/124.1; 40/152.1

[58] Field of Search ..... 40/605, 152.1, 124.1, 40/156

[56] References Cited

U.S. PATENT DOCUMENTS

| | | | |
|---|---|---|---|
| 3,269,043 | 8/1966 | Swanson | 40/124.1 |
| 3,460,282 | 8/1969 | Swirsky | 40/152 |
| 3,594,939 | 7/1971 | Parker | 40/156 |
| 3,608,221 | 9/1971 | Harris | 40/605 |
| 3,642,144 | 2/1972 | Brooks | 44/505 |
| 3,685,666 | 8/1972 | Rose | 40/605 |
| 3,817,396 | 6/1974 | Markson | 40/605 |
| 4,078,325 | 3/1978 | Valentine | 40/530 |
| 4,194,313 | 3/1980 | Doening | 40/605 |
| 4,233,765 | 11/1980 | O'Mullan | 40/156 |
| 4,294,029 | 2/1984 | Holson | 40/530 |

*Primary Examiner*—Gene Mancene
*Assistant Examiner*—Wenceslao J. Contreras
*Attorney, Agent, or Firm*—John A. Waters

[57] ABSTRACT

A multi-panel display comprises a plurality of rectangular panels formed of a foam core laminate interconnected at adjacent side edges by flexible plastic strip hinges formed of resilient sheet material and fastened in slots in the adjacent side edges of the panels. The outer edges of the panels include longitudinal slots that extend around the outer periphery of the panel display. The front and back surfaces of the panel display are covered by a loop fastener fabric, with the ends of the fabric on the front and back surfaces extending over the outer edges of the panel display and tucking into the slots around the periphery of the panel display so as to conceal the ends of the fabric. Separate panel display sections can be interconnected by stiff splines that fit in the slots in opposing edges of display sections placed edge-to-edge on top of each other. Panel display sections can be interconnected horizontally by hook fabric strips inserted in the outer side edges of the panel displays.

21 Claims, 7 Drawing Figures

LIGHTWEIGHT MULTI-PANEL DISPLAY

BACKGROUND OF THE INVENTION

This invention relates to a lightweight multi-panel display that can serve as a tabletop display board for promotional materials or can serve as a free-standing partition and backdrop display.

Advertising displays can either be tabletop displays or can serve as backdrop displays for a trade show booth. Trade booth displays frequently are custom manufactured units that are expensive, cumbersome and difficult to transport, store, erect and disassemble.

Folding displays also are known, but these frequently are deficient in some respects and are of limited versatility.

One of the purposes of the present invention is to provide an improved multi-panel display that is easily foldable, inexpensive, and light weight, and can be erected, disassembled, and stored, without requiring special technicians or trained personnel.

Another object of the invention is to provide a free standing multi-panel display that comprises separate panel sections that can be innerconnected along side and top and bottom edges to provide displays of different sizes and configurations.

It is a further object of the present invention to provide an aesthetically pleasing panel configuration wherein panel sections are connected together by lightweight hinges and the entire surface of the panel section and the edges are covered by a fabric, with no visible seams or fabric ends.

SUMMARY OF THE INVENTION

In accordance with the present invention, a free-standing multi-panel display comprises a plurality of individual panels having front and back surfaces and top and bottom and side edges. The panels are arranged side by side and are adapted to stand on the bottom edges. Each panel has longitudinal slots formed in at least the side edges that face adjacent panels. Pliable strip hinges innerconnect the side edges of adjacent panels. Each strip hinge comprises an elongated strip of readily flexible plastic sheet material having side edges that are fastened to the opposing side edges of adjacent panels preferably in perpendicular slots between the front and back surfaces of the panels, leaving a flexible intermediate portion of the strip between the panels that serves as a hinge. A display surface formed of a flexible sheet material is affixed to at least the front surface of the panel display and extends over adjacent panels and their connecting strip hinges so as to form a continuous surface over the multi-panel display.

Slots also extend the length of the outer side edges and top and bottom edges of the multi-panel display, and the sheet material fits over the edges and is tucked in the slots, thereby covering the outer edges of the panel display with no seams or fabric ends or edges showing.

The rear surface of the display similarly is covered with flexible sheet material, and the sheet material extends over the outer side edges of the top and bottom edges of the panel display and tucks in the slots in the edges. Thus, the entire multi-panel display is covered with a sheet material with no visible seams.

Desirably, the outer corners of the panel display are rounded so as to provide a smooth outer contour to the panel display. Also, it is desirable that the material covering the panel display is formed of a loop fastener material of the type used in a hook and loop fastener system. Such material comprises a loop fabric having a compressible backing. Desirably the material is attached to the surface of the panel display by means of a pressure sensitive adhesive such as a contact cement.

Separate panel sections can easily be connected together vertically to form a higher display or a partition by means of a plurality of elongated stiff flat splines. Each spline has a lower edge that fits downwardly in the slot in the top edge in the lower display section. The spline protrudes upwardly past the top of the panel section to an upper edge that can be fitted in the slot in the bottom edge of an upper display panel section. These splines will support the upper and lower display sections in edge-to-edge relationship on top of each other but permit easy separation of the display section simply by pulling the sections apart.

Horizontally adjacent panel display sections also can be connected together for creating a wider display or for innerconnecting display sections in any given pattern by means of hook fastener strips that are inserted in the outer side edges of one of the two panels to be joined. Desirably these hook fastener strips are folded over so that hook fastener material is on both outer sides of the strip and extends around the outer side of the folded edge of the strip. The folded edge of the strip protrudes out of the side edge in the panel and is engagable with the fastener material on an adjacent panel to join the panels.

These and other advantages and features of the present invention are described in detail below and shown in the appended drawings.

DETAILED DESCRIPTION OF PREFERRED EMBODIMENT

Figure 1:
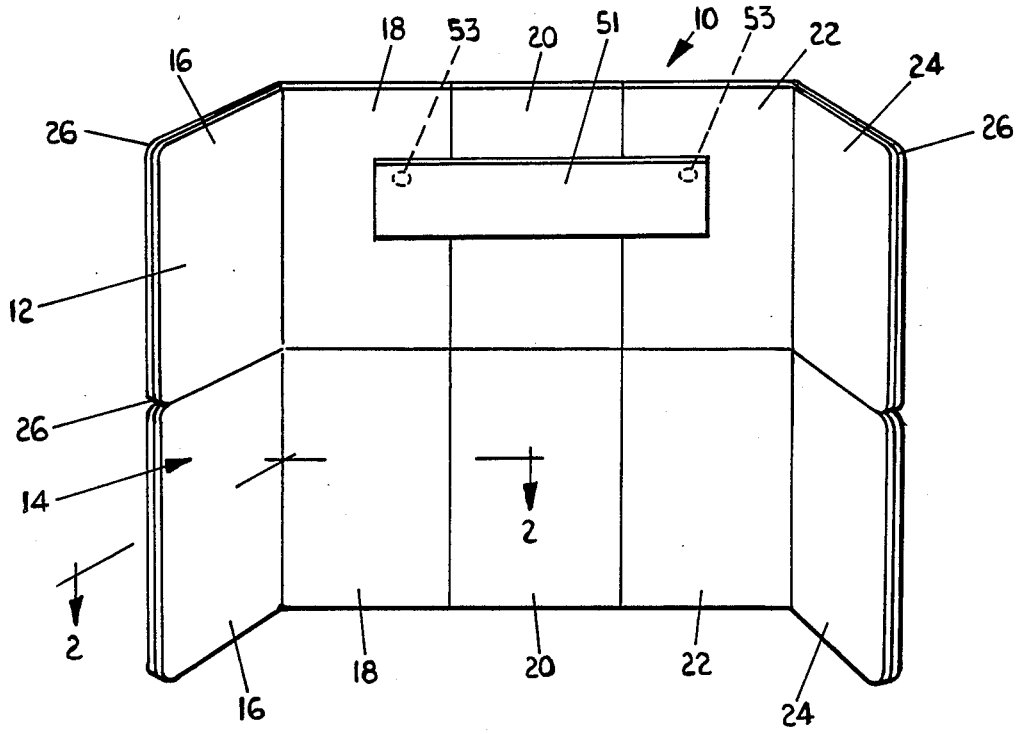
FIG. 1 is a perspective view showing two five panel display sections mounted one on top of the other to form a backdrop display for a trade show booth.

Referring to the drawings, a display system 10 constructed so as to serve as the partition for a trade show booth comprises mating upper and lower display sections 12 and 14 respectively, with each display section including five innerconnected panels 16, 18, 20, 22 and 24. Sections 12 and 14 are identical. Panels 18, 20, and 22 are identical, and outer panels 16 and 24 are identical to the other panels except that they have rounded outer corners 26 that give the entire panel system a smooth outer configuration.

Each display section comprises a plurality of rigid panels innerconnected by flexible plastic hinges 28 and completely covered with a flexible sheet material 30 that is affixed at least to the front surface of the panel display and extends over adjacent panels and their connecting strip hinges so as to form a continuous surface over the multi-panel display. The flexible sheet material desirably is a fabric and preferably a loop fabric of the type that is used in connection with a hook and loop fastener system such as Velcro or the like. Such a covering for the panel system comprises an outer fabric layer 32 covered with loop type of material, with a compressible backing 34 formed of foam rubber, foam plastic or the like. Such a fabric is readily available commercially.

The individual panels preferably are a lightweight laminated foam panel consisting of a rigid polystyrene core 31 faced on both sides by a smooth moisture resistant veneer 33 made of wood fibers such as melamine or the like. An appropriate foam material is sold under the brand name Gatorfoam. Preferably the individual foam panels are approximately one-half inch thick.

Individual panels are joined together by flexible plastic hinges 28. The opposing edges of adjoining panel sections are formed with longitudinal slots 36 that extend inwardly along the entire length of the side edges. Slots 36 preferably are 0.120 to 0.130 inches wide and extend inwardly into the panel about $\frac{3}{4}$ of an inch. The material for hinges 28 comprises an elongated strip of thin, readily flexible plastic sheet material having high flexibility and high flex life and is tough enough to resist tearing and tensile breakage of the hinge. Desirably, the hinge material is about 0.010 inches thick, and the strips are about $2\frac{5}{8}$ inches wide. A flexible butyrate plastic material sold under the name Transiluy is particularly suitable. A side edge 40 of each strip is inserted all the way to the base of each slot 36 in opposing side panels, leaving a uniformly flexible intermediate portion 29 at least $1\frac{1}{8}$ inches wide between the panels. This spacing allows sufficient room for the panels to be folded together in accordian fashion (See FIG. 7) while still allowing graphic materials as thick as a 3/16 inch graphic panel 37 to remain on the display for shipping purposes.

The hinges 28 are fastened in the slots in the panels by means of silicone adhesive 39 or like adhesive that does not react with the plastic in the hinge or with the foam core of the foam panels.

Figure 3:
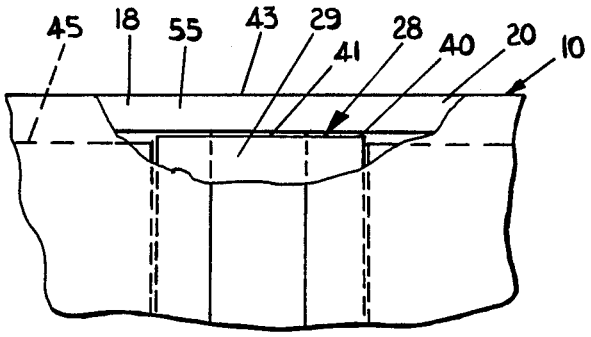
FIG. 3 is a front elevational view showing the manner in which adjacent corners of the panels are joined together, with part of the panel being broken away to show the upper edge of the hinge and the folded fabric covering.

As shown in FIG. 3, hinges 28 extend almost the full length of each panel, with opposite ends 41 terminating a short distance (approximately $\frac{1}{2}$ to $\frac{5}{8}$ of an inch) from the top edge 43 of the panel display.

In addition to the slots in the adjoining side edges of the panels, the panels are provided with the same size slots 45, 47, and 49, respectively, along the top and bottom edges and along the outside edges of the outer panels, with the corners of the outer panels being rounded or curved.

The loop fastener fabric 30 is affixed to the panel display by means of an adhesive such as contact cement. The contact cement is sprayed on the surface of the panel and on the hinges between the panels and the fabric is smoothly applied to the panel surfaces and tucked into the spaces between the panels so as to contact smoothly the edges of the panels and the hinge material between the panels. This provides each panel display with a smooth, continuous fabric outer surface that is particularly well suited to attachment of graphic display devices such as sign 51 in FIG. 1 by means of complimentary hook fasteners 53 attached to the back of the graphic display panels.

The slots in the outer periphery of the panel display are an important feature of the present invention. They make it possible for the display panel to have a fabric covered surface and edges without any visible seams or fabric ends or edges. With the slots in the outer edges, the ends of the fabric covering the surface of the panel are simply folded over the edges of the panels and tucked into the slots in the sides of the panels. It is not necessary to employ an adhesive since the compressible backing on the fabric and the size of the slots provides for a good friction fit of the fabric and the slots.

Figure 2:
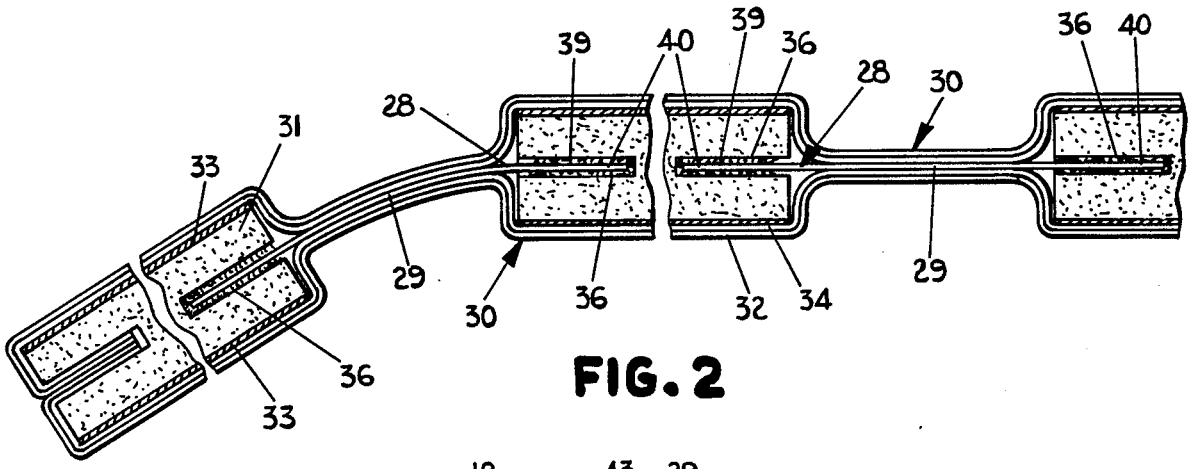
FIG. 2 is a view taken along line 2—2 of FIG. 1.

As shown in FIG. 2, fabric coating 30 also covers the back side of the panel in the same manner as the front side of the panel display. Thus, either side of the panel display can be used as the front of the display. The fabric on the back of the panel similarly is tucked into the slots around the outer periphery of the panel display in order to provide a panel display having a complete, smooth, and interupted fabric coating with no visible seams. The rounded corners on the outer panels of the display make it easier to tuck the fabric into the slots at the corners of the display and enhance the smooth aesthetic appearance of the display.

Referring again to FIG. 3, when the fabric is folded over and tucked into the slots in the top and the bottom of each display panel, this provides a double layer of fabric 55 for the front and back surfaces of the display in the area between adjacent panels. Because the folded edges of the fabric at the top and the bottom of the panel are thicker than the single layer of fabric between the folded edges, the living hinge material is formed so that it terminates adjacent the inner edge of the folded material. With the living hinge material providing added thickness to the panel display, this at least partially offsets the extra thickness presented by the double layer of material at the top and bottom edges of the panel and enhances the smooth, seamless appearance of the panel display. The folded fabric at the top and bottom of each panel is fastened together by a suitable adhesive material and the fabric on the back and the front of the panel are fastened together by similar adhesive.

Figure 4:
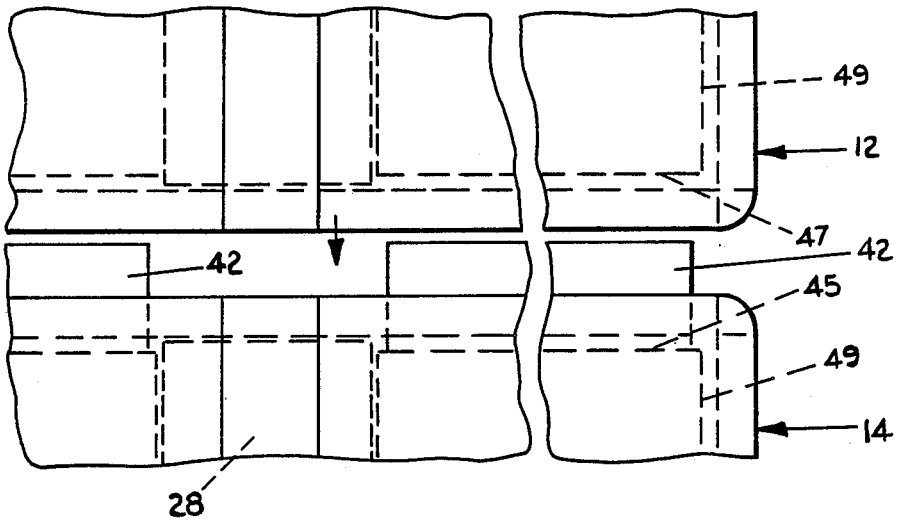
FIG. 4 is a partial front elevational view showing the manner in which separate display sections are mounted on top of each other by means of innerconnecting splines.

The manner in which display sections 12 and 14 are innerconnected is shown in FIG. 4. In the illustrated embodiment, each panel is about two feet wide and four feet high, thus making each panel section about four feet high and ten feet wide. When two panel sections are placed one on top of the other, a partition or wall system eight feet high is created. To do this, a stiff spline 42 preferably formed of styrene plastic is inserted downwardly in the slot in the top edge of each panel in lower panel section 14. Each spline is about 0.040 to 0.060 inches thick and is snuggly received between the layers of compressible loop fastener material tucked in the outer slots of the panels. The styrene spline is approximately $1\frac{3}{8}$ inches high, so that the upper edge of the spline protrudes well beyond the top edge of the lower panel section. This upper edge of the spline fits upwardly into the slot in the bottom edge of the upper display section 12. Spline 42 extends a substantial portion of the width of each panel section and is sufficiently rigid so that it maintains the upper panel member in mating, edge-to-edge position on the lower panel. Splines are inserted in each of the panels in each display section. These splines are sufficiently rigid that when the panels are arranged in a manner as shown in FIG. 1 or the like, the upper display section 12 is maintained rigidly in place on the lower display section 14, creating a wall section eight feet high and ten feet wide that is movable and foldable in much the same manner as one display section alone.

One advantage of the present system is that these sections can be installed and disassembled easily by sales personnel attending a convention and do not require the presence of carpenters or other expensive technical assistance that are hired specifically for erecting and disassembling trade show displays.

While the size of each panel shown in the exemplary embodiment is two feet by four feet, so as to create a ten foot by eight foot display, panels of any size can be employed in the present invention. For example, a display employing three panels, with each panel being two feet high by sixteen inches wide is a good size for a tabletop display.

Figure 5:
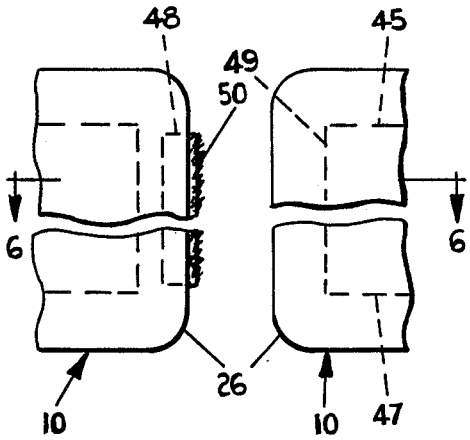
FIG. 5 is a front elevational view of the edge of a panel display section showing the manner in which horizontally adjacent panel display sections can be joined by means of a hook fastener strip inserted in the outer edge of one panel display section.
Figure 6:
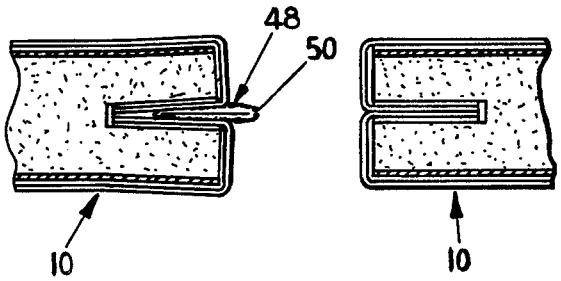
FIG. 6 is a view taken along line 6—6 of FIG. 5.

The manner in which separate display sections are connected together horizontally to form displays of different configurations is shown in FIGS. 5 and 6. To do this, a strip of hook fabric 48 is inserted in the outer side edges of a panel section, so that a small portion of the hook fabric 50 protrudes out of the side edge of the panel. As shown in FIG. 6, it is desired that the hook fabric be folded over before it is inserted in the slot in the edge of the panel, so that hook material covers both sides of the strip and extends around the outer surface of the folded edge. The folded edge is portion 50 extending outwardly from the slot, with the hook fabric extending around the folded edge as a means to engage the loop fabric on an adjacent display section 10 brought in contact with the hooked material. Again, because of the hook and fastener type of construction and because of the compressibility of the fastener material tucked in the slots, it is not necessary to use an adhesive to hold the hook material in the edge of the slot.

The use of material in this way can be used to connect two sections of panel together edge-to-edge. Also, it can be used to connect the edge of one panel section perpendicularly or at any angle to the front surface of another panel section. Also, it can be used to suspend display signs or panel sections of different sizes between two opposed panel sections in a display. For example, a thin, long panel could extend all the way between panels 24 and 16 of the display and could be connected at each end to the loop fabric on the surface of panels 16 and 24. In this manner, the panel could be positioned forwardly of the back of the panel display and suspended out at the front of the panel display adjacent corners 26. Suitable signage could then be attached to the panel.

The strips of hook material inserted in the slots in the side edges of the panels desirably extend outwardly from the side edges about ⅛ inch. These strips could be any length, including the full length of the panel. Alternatively, shorter strips about 6 inches long could be used.

A display constructed in accordance with the present invention provides an attractive, light weight, easy to assemble and inexpensive system for constructing a trade booth at a convention or for constructing a display for any purpose. The smooth outer surface, even at the edges between the splines and the folded fabric in the hinged sections, presents a smooth, aesthetic outer appearance, with smooth rounded edges and a seamless construction.

Figure 7:
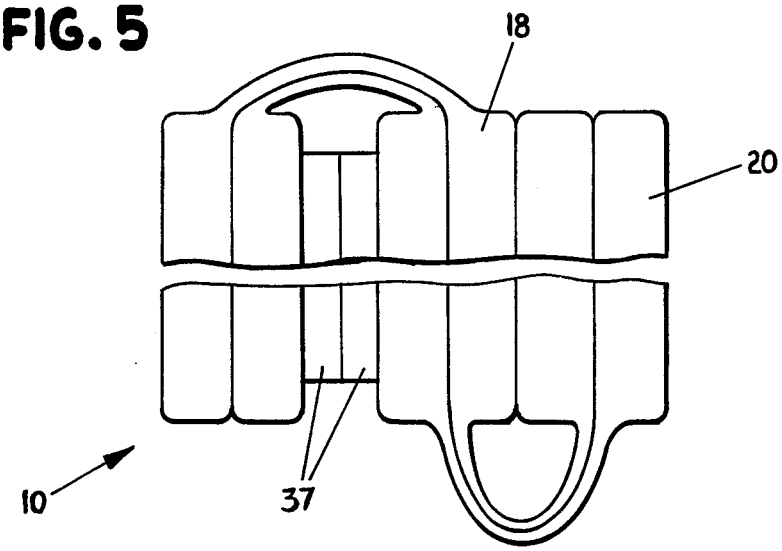
FIG. 7 is a plan view showing the panel display section folded in accordian fashion.

As shown in FIG. 7, the advertising display occupies very little space when not in use and can be folded in accordian fashion for storage. The uniform flexibility of the intermediate portion of this hinge and the extra wide hinge spacing between panels makes it possible to fold the panels together even while graphic panels as large as 3/16 of an inch remain mounted on the display. As shown the hinge material forms an arc or curve when the panels are folded or skewed. When graphic panels are not present, the unique flexible hinges permit the display panels to lie flat against each other (a feature not present in plastic hinges comprising stiff material with only a thin flexible section in the material). A panel folded in this manner can easily be fit into conventional shipping cartons for transportation to and from desired display locations. This is in sharp contrast to many conventional advertising displays that have to be shipped by special trucks in special shipping containers and require an unusually large amount of storage space when not in use.

By employing a display of the type represented by the present invention, attractive and very functional displays are easily within the cost budget at even a small company, and excessive one time construction costs for advertising displays can be avoided.

It should be understood that the foregoing embodiment is merely representative of the preferred practice of the present invention and that various changes in the details and arrangements of construction of this embodiment may be made without departing from the spirit and scope of the present invention, as defined in the appended claims.

I claim:

1. A free standing multi-panel display comprising:

a plurality of panels having front and back surfaces and top, bottom, and side edges, the panels being arranged side-by-side, each panel having longitudinal slots in at least the side edges facing adjacent panels;

pliable strip hinges interconnecting the side edges of adjacent panels, each strip hinge comprising an elongated strip of readily flexible sheet material having side edges that are fastened in slots in the opposing side edges of adjacent panels, leaving a flexible intermediate portion of the strip between the panels that serves as a hinge, the intermediate portion being wide enough to permit adjacent panels to be folded flat against each other in either direction such that either the front or back surfaces of the panel abut each other; and a display surface formed of flexible sheet material affixed to at least the front surface of the panel display and extending over adjacent panels and their connecting strip hinges so as to form a continuous surface over the multi-panel display.

2. An advertising display according to claim 1 wherein slots extend the length of the outer side edges and top and bottom edges of the panels and the sheet material fits over said edges and is tucked in said slots, thereby covering the outer edges of the panel display with no seams or fabric ends showing.

3. A display according to claim 2 wherein the rear surface of the display also is covered with flexible sheet material that extends over the outer side edges and the top and bottom edges of the panels and tucks in the slots in said edges, providing the entire multi-panel display with a sheet material covering with no visible seams.

4. A display according to claim 3 wherein the strip hinges have side edges that fit in and are fastened in longitudinal slots formed in the opposing side edges of adjacent panels at a position between the front and back surfaces of the panels, the hinges having top and bottom ends that terminate at a point spaced apart from but adjacent to the top and bottom edges of the panels, the sheet material on the front and back surfaces of the panel display being folded over between the two layers of sheet material at the top and bottom ends of the strip hinges and being attached together at that point, the double layers of sheet material at the top and bottom ends of the strip hinges filling in the space between the strip hinge and the top and bottom edges of the panel display so as to provide a generally smooth surface from the top to the bottom of the panel display at the strip hinges, with the folds in the sheet material being concealed.

5. A display according to claim 3 wherein the outer panels have rounded outer corners and the slots extend around the rounded corners the sheet material being tucked in the slots in the panels around the complete outer periphery of the panel display.

6. A display according to claim 3 wherein the sheet material is loop fastener fabric having a compressible backing, the fabric being bonded by pressure sensitive adhesive to the panels and the intermediate hinge portions.

7. A display according to claim 6 and further comprising hook fastener means for interconnecting horizontally adjacent panel sections, the hook fastener means including a strip of hook fastener material inserted in the slot in the outer side edge of one of the panels to be joined, the hook fastener material protruding outwardly from the side edge of the panel so as to be interlockingly engagable with the loop fastener material on an adjacent panel display section.

8. A display according to claim 7 wherein the hook fastening material comprises a strip of material that is folded over so as to have hook fastener material on both sides of the folded strip and hook fastener material around the outer surface of the folded edge of the strip, the strip being inserted in the slot in the side edge of the panel section so that the folded edge protrudes from the slot.

9. A display according to claim 1 wherein each panel comprises a lightweight molded foam plastic core, with smooth and non-porous front and back surface layers thereon.

10. A display according to claim 9 wherein the front and back surface layers comprise wood fiber sheet material laminated to the intermediate foam portion of the panel.

11. An advertising display according to claim 1 wherein the intermediate portion of the hinge is sufficiently wide to permit adjacent panels to be folded flat in accordian style without the necessity of first removing from the panels display materials that are at least up to about 3/16 inches thick.

12. A display according to claim 11 wherein the panels are about one-half inch thick and the spacing between adjacent panels is about one and one-eighth inches or larger.

13. A display according to claim 2 wherein the panel display comprises at least two separate multi-panel display sections mounted edge to edge on top of each other, the display sections being supported on one another by a plurality of elongated stiff, flat splines that fit in opposing slots in the top and bottom edges of adjoining panels, each spline having a lower edge that fits downwardly in the slot in the top edge of a panel in the lower display section, the spline protruding upwardly past the top of the panel to an upper edge that fits in the slot in the bottom edge of the upper display panel section, the spline supporting the upper and lower display sections on top of each other but permitting easy separation of the display sections simply by pulling the sections apart.

14. A display according to claim 13 wherein the splines are formed of styrene plastic about 0.040 to 0.060 inches thick.

15. A multi-panel display according to claim 1 wherein each strip hinge comprises a thin, readily flexible strip of butyrate sheet plastic material that is attached at side edges by an adhesive in the slots, which extend substantially perpendicularly into the opposing side edges of adjacent panels between the front and back surfaces thereof, the entire intermediate portion of the strip being uniformly flexible so as to produce a curve when adjacent panels are positioned at skewed angles with respect to each other.

16. A multi-panel display comprising a plurality of rectangular panels formed of a foam core laminate interconnected at adjacent side edges by hinges, the outer edges of the panel display including longitudinal slots that extend around the outer periphery of the panel display, front and back surfaces of the panel display being covered by a fabric, with the ends of the fabric on the front and back surfaces extending over the outer edges of the panel display and tucking into the slots around the periphery of the panel display so as to conceal the ends of the fabric.

17. A multi-panel display according to claim 16 and further comprising spline means for vertically interconnecting separate display sections, the spline means comprising stiff splines that fit in opposing slots in vertically mated panels and maintain the panels in edge-to-edge relationship on top of each other.

18. A multi-panel display according to claim 16 wherein the fabric comprises loop fastener fabric and the display further comprises hook fastener means for attaching the side edge of one display section with the loop fastener fabric of another display section, the hook fastener means comprising a strip of hook fastener material inserted in the slot in the outer side edge of a display section such that a portion of the hook fabric protrudes from the slot in position for locking engagement with the loop fastener fabric of an adjoining display section.

19. A multi-panel display according to claim 16 wherein the hinges comprise strips of flexible plastic sheet material that are fastened in slots in opposing side edges of the panels and extend between the edges of the panels.

20. A multi-panel display according to claim 19 wherein the strip hinges are formed of flexible butyrate plastic about 0.010 inches thick.

21. A multi-panel display according to claim 19 wherein the plastic strips terminate at top and bottom ends that are spaced apart from but are adjacent to top and bottom edges of the adjoining panels, the ends of the fabric covering the panels being folded over inwardly at the top and bottom of the hinges and extending inwardly about to the ends of the plastic strips, the thickness of the plastic strips serving to conceal the junction between the double layer of folded fabric and the single layer of fabric inward of the double layer.

* * * * *